US005261519A

United States Patent [19]

Zirkiev

[11] Patent Number: 5,261,519

[45] Date of Patent: Nov. 16, 1993

[54] FERRO-MAGNETIC SLUG REJECTION SYSTEM FOR A COIN CHUTE ASSEMBLY ADAPTED TO RECEIVE COINS IN A VERTICAL POSITION

[75] Inventor: Arkady Zirkiev, Forest Hills, N.Y.

[73] Assignee: Greenwald Industries Inc., Brooklyn, N.Y.

[21] Appl. No.: 938,710

[22] Filed: Sep. 1, 1992

[51] Int. Cl.[5] ..... G07D 5/08

[52] U.S. Cl. ..... 194/235; 194/325

[58] Field of Search ..... 194/320, 321, 325, 238, 194/235

[56] References Cited

U.S. PATENT DOCUMENTS

| | | | |
|---|---|---|---|
| 799,045 | 9/1905 | Grover | 194/320 X |
| 1,109,690 | 9/1914 | Merkle | 194/321 |
| 1,957,091 | 5/1934 | Block | 194/320 X |
| 2,026,921 | 1/1936 | Tratsch et al. | 194/320 X |
| 2,233,653 | 3/1941 | Tratsch | 194/320 |
| 3,602,352 | 8/1971 | Robinson | 194/238 |
| 3,978,960 | 9/1976 | Mellinger et al. | 194/235 |
| 4,221,285 | 9/1980 | Greenwald et al. | 194/238 |
| 4,502,584 | 3/1985 | Lambiris | 194/257 |
| 5,027,936 | 7/1991 | Boyett | 194/325 |

*Primary Examiner*—F. J. Bartuska

*Attorney, Agent, or Firm*—McAulay Fisher Nissen Goldberg & Kiel

[57] ABSTRACT

An improved mounting arrangement of a magnet within a coin chute assembly is disclosed which serves as a ferro-magnetic slug rejection system for a coin chute adapted to receive coins in a vertical position. The coin chute includes a coin slide disposed for movement inwardly of the assembly to an operate position. The coin chute has a flange formed with a recessed portion in its inner surface. A magnet is a cover plate which is fitted and secured within the recessed portion of the flange. The magnet raises the slug carried by the coin slide so that inward movement of the slide causes the slug to abut against an abutment surface of the assembly thereby to prevent continued inward movement of the slide to its operate position.

8 Claims, 2 Drawing Sheets

FERRO-MAGNETIC SLUG REJECTION SYSTEM FOR A COIN CHUTE ASSEMBLY ADAPTED TO RECEIVE COINS IN A VERTICAL POSITION

BACKGROUND OF THE INVENTION

1. Field of the Invention

This invention relates to an improved mounting arrangement of a magnet within a coin chute assembly. The coin chute includes a coin slide adapted to receive coins in a vertical position and which is disposed for movement inwardly of the assembly to an operate position. The magnet raises a ferro-magnetic slug carried by the coin slide so that inward movement of the slide causes the slug to abut against an abutment surface of the assembly thereby to prevent continued inserted movement of the slide to its operate position.

2. Description of the Prior Art

Coin chute assemblies are usually installed on commercial appliances such as clothes washers, dryers, vending machines, and the like. The assembly typically is enclosed within a housing mounted on the appliance or machine. The assembly includes a coin chute having a coin slide reciprocally mounted in a guide track for inserted or inward movement of the assembly and retracted or outward movement thereof. The coin slide is formed having one or more coin receiving slots whereby the presence of an appropriately sized coin in the slot is operative to allow inward movement of the coin slide to an operate position thereof. The inner end of the coin slide is provided with an operator for actuating the appliance or machine upon continued movement of the slide inwardly to its operate position.

The housing of the assembly usually is provided with a locked coin drawer which prevents unauthorized access to a coin receptacle located below and in spaced relation to the coin slide. The arrangement is such that the coins necessary to operate the appliance or machine are carried by the coin slide upon inserted movement of the slide to its operate position whereupon the coins exit from the assembly through suitable openings thereby to be transmitted to the coin receptacle.

In the prior art, there are numerous types of coin chute assemblies which are operable by means of a plurality of coins carried by the coin slide either in a flat or horizontal position, or in an upstanding edge or vertical position. Two of such assemblies are exemplified by U.S. Reissue Pat. No. Re. 31,085 dated Nov. 23, 1983 in the name of Harry Greenwald et al., and U.S. Pat. No. 4,502,584 dated Mar. 5, 1985 in the name of Christos Lambiris.

In any coin handling mechanism, it is desirable to provide means to reject ferro-magnetic slugs which are used to operate the mechanism without the presence of proper coins. Such slug rejection systems typically include a magnet mounted within the housing and positioned to raise a slug carried by a coin slide out of its intended path of travel. Raising of the slug causes it to be carried against a stop or abutment surface within the housing or coin chute assembly to prevent further inward movement of the slide to its operate position.

The mounting of such a magnet in a coin chute assembly wherein the coin slide carries coins in a horizontal position has not presented a problem. There is suitable space and support within the housing to mount the magnet for it to perform its intended function. The magnet need not be too large nor its pulling force too strong since the influence of the magnet is over the flat and relatively large surface of the slug. In contrast, the use of a magnet in instances where the coin slide carries the coins in a vertical position ("vertical coin chutes") has proven quite troublesome. A much more powerful magnet is needed since the pulling or lifting force is confined to an edge of the slug. While there has been some success in the use of a magnet carried by vertical coin chutes, the placement of the magnet has proven tedious and unreliable, particularly in view of its required strength.

That is, it is known to manually position the magnet within the housing in a frictionally fitting or wedge-like engagement against a vertical face of the housing at a position above where the slug is carried by the coin slide. However, as a result of repeated operation of the slide which produces an impact on the housing, and the presence of other stationary ferro-magnetic material included as part of the coin chute mechanism which exerts a pull on the magnet, the magnet has a tendency to become dislodged from its mounted position so as to have little or no effect on a slug that may be carried by the slide.

It is also know, as shown in U.S. Pat. No. 5,027,936 dated Jul. 2, 1991 in the name of Timothy E. Boyett, to support a cylindrical magnet as a component of the coin rejection station of a coin chute assembly. The coin rejection station is spaced considerably inboard and out of engagement with the coin chute flange of the assembly. A cylindrical stop member also is mounted to the coin rejection station and is spaced inboard of the magnet. In operation, inward movement of the coin slide carries the slug to a position where it is lifted by the magnet out of the path of travel of the slide. Thereafter, continued inward movement of the slide causes the slug to bear against the cylindrical stop thereby to jam the mechanism and prevent continued inward movement of the slide to its operate position. The Boyet slug rejection system is not deemed reliable in operation and is not practical because of space limitations within the housing.

The present invention is directed toward an improved mounting arrangement for the magnet in a vertical coin chute which is easy to install and reliable in operation, and comes within the space limitations of existing coin chute assemblies.

SUMMARY OF THE INVENTION

The improved mounting arrangement for the magnet herein is applicable to a coin chute assembly formed with a vertical flange which is adapted to be mounted to the vertical face of a coin meter housing. The coin chute flange is formed having an outer surface and an inner surface, and is provided with coin slot openings to permit the passage of coins therethrough.

The coin chute assembly further includes a coin slide disposed for reciprocal movement for carrying vertically oriented coins positioned in the slide outboard of the outer surface of the coin chute flange through the coin slot openings in the coin chute flange. In operation, the presence of one or more proper coins in the coin slide permits the slide to be moved inwardly of the assembly to an operate position.

The inner surface of the coin chute flange is formed having a recessed portion. A cover plate is provided which is removably mounted within the recessed portion of said flange and held in place by bolt fasteners. The cover plate has a cut-out portion defined by an upper edge and opposed side edges which is configured to permit passage of coins therethrough upon inward movement of the coin slide. The juncture where the upper edge meets with the side edges of the cut-out portion defines opposed notch edges of the cut-out portion.

A magnet is provided having opposed end edges which are fitted or received within the notched edges of the cut-out portion so as to be carried by the cover plate and securely held in place. The arrangement is such that the magnet is located inboard of the outer surface of the coin chute flange and positioned above the coin slot openings of the flange.

In operation, inward movement of the coin slide places an edge of a ferro-magnetic slug carried by the slide under the magnet causing the slug to be lifted up against the magnet. The slug is now positioned such that continued inward movement of the slide causes the raised slug to abut against an abutment surface of the assembly to prevent further inward movement of the slide to its operate position.

For a more complete appreciation of the invention, and its various features and advantages, reference should be made to the following detailed description when taken in conjunction with the following drawings:

DESCRIPTION OF THE PREFERRED EMBODIMENT

Figure 1:
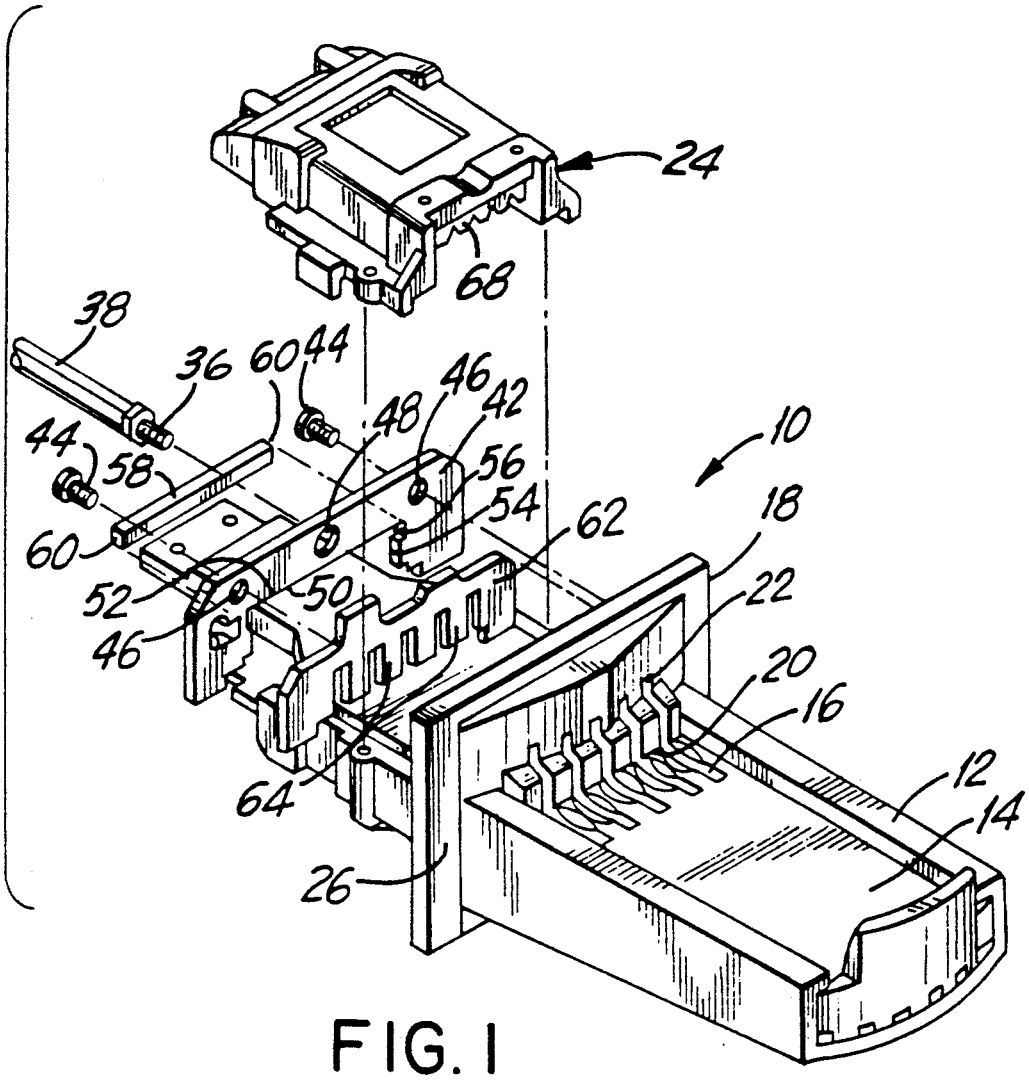
FIG. 1 is an exploded perspective view of the associated elements of the coin chute assembly.

Referring to the drawings, and particularly to FIG. 1, there is shown a coin chute assembly represented generally by numeral 10. Assembly 10 includes a guide track 12 reciprocally supporting a coin slide 14 for inserted or inward movement of the assembly and retracted or outward movement thereof. Coin slide 14 is formed having a plurality of coin support slots 16 each adapted to hold a coin placed therein in a vertical plane.

Coin chute assembly 10 also includes a vertical flange 18 formed having a substantially centrally located opening 20 through which passes the coin carrying portion of coin slide 14. Flange 18 further is formed having a plurality of open ended slots 22 disposed vertically and in parallel relation to one another. The open ends of slots 22 communicate with central opening 20 to permit passage of the coins carried by coin slide 14 in a vertical or standing-on-edge position upon inward movement of the coin slide, whereby the coins pass through flange 18 and are carried to a coin sizing mechanism represented generally by numeral 24 as hereinafter described.

Figure 2:
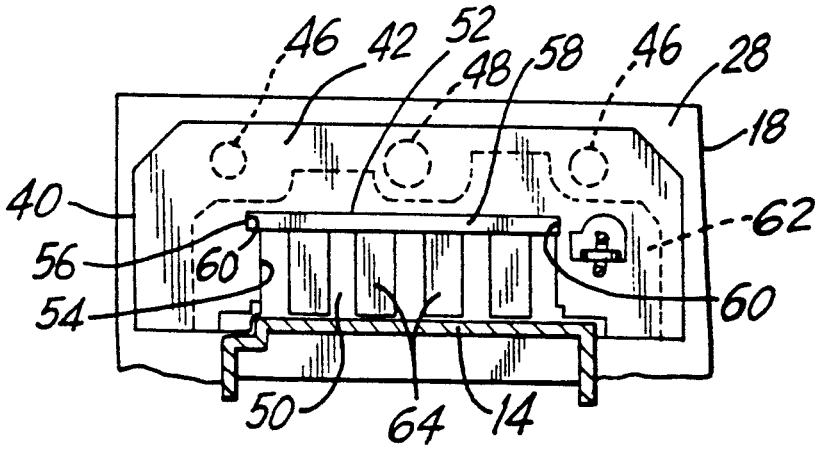
FIG. 2 is a partial elevational view of the inner surface of the coin chute flange showing the cover plate which carries the magnet mounted within the recessed portion of the flange, and representing the improved mounting arrangement of the magnet embodying the present invention.
Figure 3:
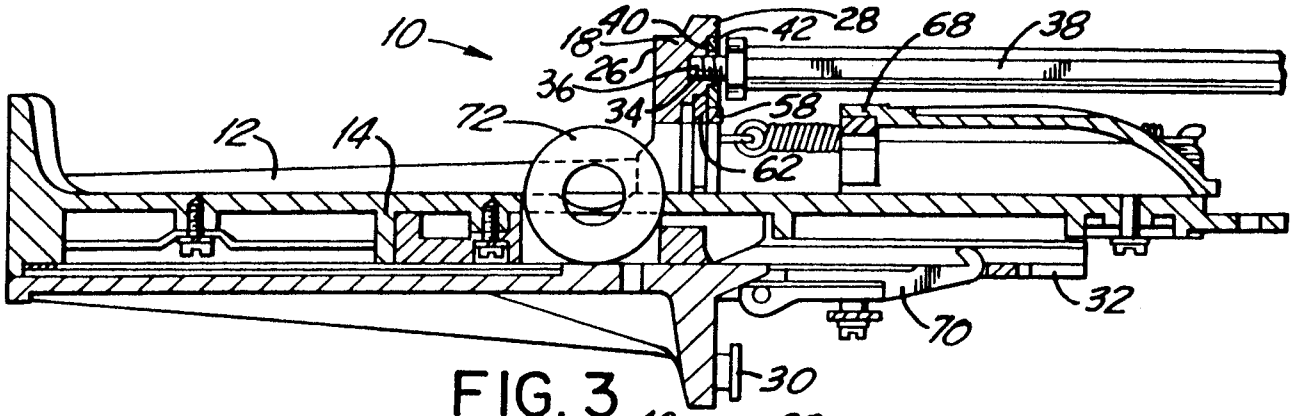
FIG. 3 is a longitudinal sectional view of the coin chute assembly as it would appear mounted to the front vertical face of a coin meter housing by a mounting bolt, the housing being removed for purpose of clarity, and showing the coin slide in its retracted coin receiving position having a ferro-magnetic slug positioned in the slide in a vertical or standing-on-edge position.
Figure 4:
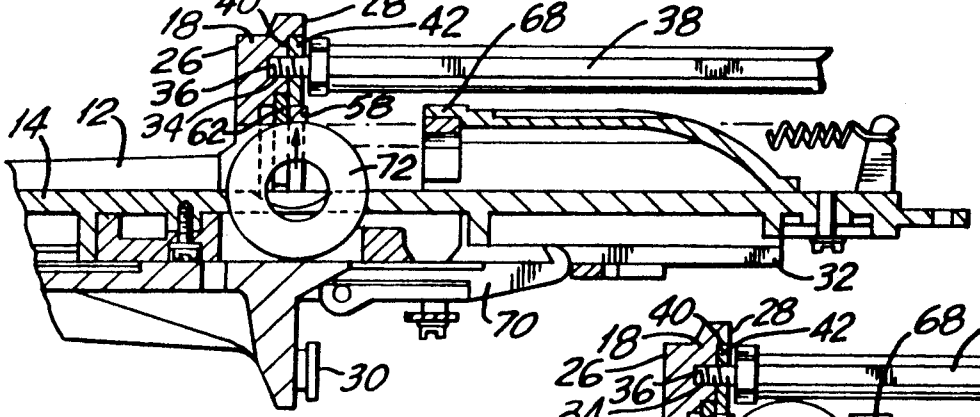
FIG. 4 is a partial sectional view similar to FIG. 3 with the coin slide advanced inwardly in the direction of its operate position, and with the slug raised out of its path of travel in contact with the magnet.

Coin chute flange 18 has an outer surface 26 and an inner surface 28 as shown in FIGS. 1 and 2. The inner surface 28 of flange 18 is formed having a plurality of projecting lugs 30, only one of which is shown in FIGS. 3 and 4, which serve to mount coin chute assembly 10 to a coin meter housing, not shown. The lugs 30 are positioned and configured so that a pair of such laterally spaced lugs are received in suitably provided openings in a face of the coin meter housing thereby to facilitate mounting of the coin chute assembly to the coin meter housing in a manner well known in the art. The arrangement is such that when coin chute assembly 10 is mounted to the coin meter housing, the inner end portion 32 of guide track 12 passes through an opening in the front face of the housing.

The inner surface 28 of coin chute flange 18 further includes a threaded opening 34 disposed centrally adjacent the upper edge of the flange. When coin chute assembly 10 is mounted to the coin meter housing, the threaded opening 34 is located in alignment with an opening in the front face of the housing for receiving the threaded end 36 of a mounting bolt 38 as shown in FIGS. 3-6.

The inner surface 28 of flange 18 is further formed having a recessed portion 40 into which is removably mounted a cover plate 42 by means of bolt fasteners 44. For this purpose, a pair of laterally spaced openings 46 are provided in plate 42 to permit passage of the shank portions of bolt fasteners 44 therethrough. Threaded openings are suitably provided in the inner surface 28 of flange 18 for threadedly engaging with bolt fasteners 44 to maintain plate 42 in place. A central opening 48 also is provided in plate 42, between the spaced openings 46, to permit passage of the threaded end 36 of bolt 38 therethrough.

As shown in FIGS. 1 and 2, cover plate 42 also is provided with a cut-out portion 50 defined by an upper edge 52 and opposed side edges 54. Cut-out portion 50 is configured to permit passage of coins therethrough upon inward movement of coin slide 14. The juncture where the upper edge 52 meets with the side edges 54 of cut-out portion 50 defines opposed notched edges 56.

In accordance with the invention, a magnet 58 is provided, in the shape of an elongated bar of rectangular cross-section, having opposed end edges 60 which are fitted or received within the notched edges 56 of plate 42 so as to be carried by the plate and securely held in place. For this purpose, magnet 58 is dimensioned having a length slightly less than the length of the cut-out portion 50 of plate 42, as measured between the opposed notched edges 56, and a width approximately the same as the width of the upper edge 52 of cut-out portion 50. In the preferred embodiment, the length of magnet 58 is approximately 1.750 inches (4.445 cm.) having a cross-section dimension of 0.080 inches by 0.100 inches (0.203 cm.×0.254 cm.). The arrangement is such that the magnet is inboard of outer surface 26 of flange 18 and positioned above the coin slot openings 22 of the flange.

If desired, a gate member 62 may be provided suitably dimensioned to also fit within the recessed portion 40 of flange 18 between an inner surface of the flange and cover plate 42. Gate 62 is disposed for sliding movement laterally of or transverse to coin slide 14 to close or block-off access to the coins in the slide inboard of flange 18. That is, gate 62 has finger elements 64 which initially are in a non-blocking position to permit passage of coins through the spaces separating the fingers. However, upon inward movement of coin slide 14, gate 62 is displaced cross-wise to locate the finger elements 64 in a blocking position to block-off the coin openings 22 in flange 18 to prevent retrieval of the coins after the slide has been inserted to its operate position. The use and operation of a gate member for this purpose is well known in the art and is not part of the present invention. The gate is referred to herein merely to show its position relative to the flange 18 and the cover plate 42.

Figure 5:
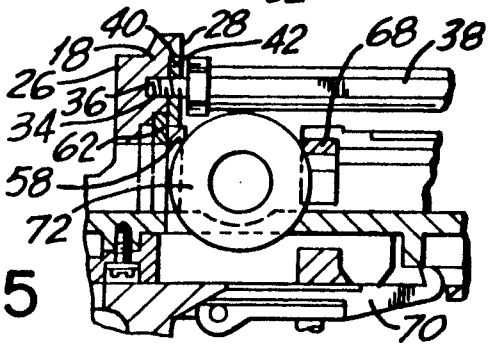
FIG. 5 is a partial sectional view similar to FIG. 4 with the coin slide advanced further inwardly to carry the raised slug in engagement with an abutment surface of the assembly to prevent further inward movement of the slide to its operate position.
Figure 6:
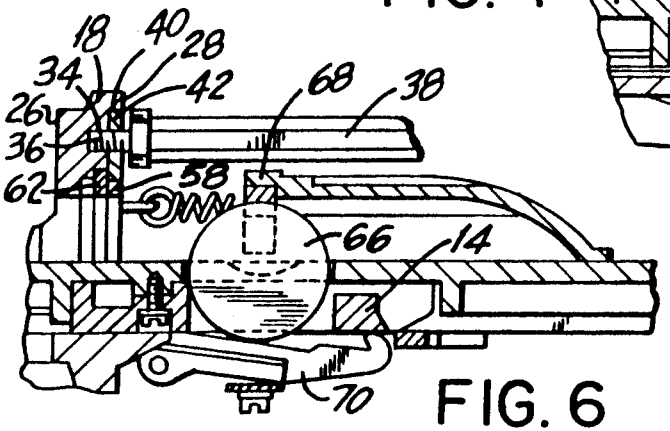
FIG. 6 is a partial sectional view similar to FIG. 4 with the coin slide carrying a proper coin in place of the slug past a coin sizing block and over a displaced blocking dog to permit continued inward movement of the slide to its operate position.

The operation of the slug rejection system can best be appreciated from a description of FIGS. 3–6. FIG. 6 illustrates a situation where coin slide 14 is carrying a proper coin 66 past the coin chute flange 18. Magnet 58 exerts no force on the coin which then is carried to a sizing block 68 of the coin sizing mechanism 24. The presence of a proper coin 66 serves to displace a blocking dog 70 downwardly out of the path of travel of coin slide 14, in a manner well known in the art, to permit continued inward movement of the coin slide to its operate position.

FIGS. 3–5 illustrate operation of the mechanism when coin 66 is replaced with a ferro-magnetic slug 72. In this instance, after the slug 72 is carried past the coin chute flange 18 as shown in FIG. 4, magnet 58 exerts a force to raise the slug out of its path of travel, in the direction of the arrow, and in contact with the magnet. However, the lower portion of slug 72 is still acted upon by movement of coin slide 14. Thus, continued inward movement of coin slide 14 with the slug 72 in the raised position causes the slug to bear against the sizing block 68. Since the raised slug cannot pass through the sizing block, the block serves as an abutment surface. Coin slide 14 is now prevented from further inward movement to its operate position. The arrangement and configuration of the parts is such that whereas coin slide 14 can no longer be inserted inwardly of the assembly, the operator can still retract the coin slide outwardly of the assembly carrying with it slug 72. This eliminates jamming of the slug within the assembly which would require servicing of the coin chute assembly by trained personnel. There is, thus, described a novel mounting arrangement of the magnet to the cover plate which is easily securely positioned in place for reliable operation.

While the present invention has been described with respect to a particular embodiment, it will be readily appreciated and understood that numerous variations and modifications thereof may be made without departing from the spirit or scope of the claimed invention.

I claim:

1. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly to an operate position, and said assembly further having an internal abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange, said magnet having opposed end edges;

the inner surface of said coin chute flange having a recessed portion;

a substantially vertical cover plate configured to be received in said recessed portion of said coin chute flange; and notch means formed in said cover plate for engaging the opposed end edges of said magnet to securely hold said magnet in place;

inward movement of said coin slide placing an edge of a ferro-magnetic slug carried by said slide under said magnet causing the slug to be raised up against said magnet;

whereby continued inward movement of said coin slide causes the raised slug to be abut against said abutment surface to prevent further movement of said coin slide to its operate position inwardly of said assembly.

2. The coin chute assembly of claim 1, wherein said cover plate has a cut-out portion configured to permit passage of coins therethrough upon inward movement of said coin slide, said cut-out portion defined by an upper edge and opposed side edges, said notch means being located at the juncture where the upper edge meets with the slide edges of said cut-out portion to define opposed notched edges, the opposed end edges of said magnet being fitted within the opposed notched edges of said cut-out portion so as to be carried by said cover plate and securely held in place.

3. The coin chute assembly of claim 2, further comprising fastener means for removably mounting said cover plate within the recessed portion of said coin chute flange.

4. The coin chute assembly of claim 2, wherein said magnet is in the form of an elongated bar which is dimensioned having a length slightly less than the length of the cut-out portion of said cover plate between the opposed notched edges thereof, and a width approximately the same as the width of the upper edge defining said cut-out portion.

5. The coin chute assembly of claim 3, wherein said magnet is in the form of an elongated bar which is dimensioned having a length slightly less than the length of the cut-out portion of said cover plate between the opposed notched edges thereof, and a width approximately the same as the width of the upper edge defining said cut-out portion.

6. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, the presence of proper coins permitting said coin slide to be moved inwardly of said assembly to an operate position, and said assembly further having an internal abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange, said magnet having opposed end edges;

the inner surface of said coin chute flange having a recessed portion;

a substantially vertical cover plate configured to be received in said recessed portion of said coin chute flange;

said cover plate having a cut-out portion defined by an upper edge and opposed side edges, said cut-out portion being configured to permit passage of coins therethrough upon inward movement of said coin slide;

the juncture where the upper edge meets with the side edges of said cut-out portion defining opposed notched edges;

the opposed end edges of said magnet being fitted within the opposed notched edges of said cut-out portion so as to be carried by said cover plate and securely held in place; and fastener means for removably mounting said cover plate within the recessed portion of said coin chute flange;

inward movement of said coin slide placing an edge of a ferro-magnetic slug carried by said slide under said magnet causing the slug to be raised up against said magnet;

whereby continued inward movement of said coin slide causes the raised slug to abut against said abutment surface to prevent further movement of said coin slide to its operate position inwardly of said assembly.

7. The coin chute assembly of claim 6, wherein said magnet is in the form of an elongated bar which is dimensioned having a length slightly less than the length of the cut-out portion of said cover plate between the opposed notched edges thereof, and a width approximately the same as the width of the upper edge defining said cut-out portion.

8. In a coin chute assembly having a substantially vertical flange formed with coin slot openings to permit the passage of coins therethrough, said coin chute flange having an outer surface and an inner surface, said assembly further having a coin slide disposed for reciprocal movement for carrying vertically oriented coins positioned in said slide outboard of the outer surface of said coin chute flange through the coin slot openings of said flange, a gate member positioned adjacent the inner surface of said flange and having coin slot openings, said gate member disposed for movement between a non-blocking position to permit passage of coins through the coin slot openings of said gate member upon inward movement of said slide and a blocking position to block-off the coin slot openings in said flange to prevent access to coins in said slide inboard of said flange, the presence of proper coins permitting said coin slide to be moved inwardly of said assembly to an operate position, and said assembly further having an internal abutment surface, the presence of a ferro-magnetic slug carried by said coin slide being detected by said assembly and carried into engagement with said abutment surface to restrict continued inward movement of said coin slide, wherein the improvement comprises:

a magnet located inboard of the outer surface of said coin chute flange and positioned above the coin slot openings of said flange and the coin slot openings of said gate member, said magnet having opposed end edges;

the inner surface of said coin chute flange having a recessed portion;

said gate member being configured to be received in said recessed portion of said coin chute flange for sliding movement therein;

a substantially vertical cover plate configured to be received in said recessed portion of said coin chute flange for holding said gate member within said recessed portion;

said cover plate having a cut-out portion defined by an upper edge and opposed side edges, said cut-out portion being configured to permit passage of coins therethrough upon inward movement of said coin slide;

the juncture where the upper edge meets with the side edges of said cut-out portion defining opposed notched edges;

the opposed end edges of said magnet being fitted within the opposed notched edges of said cut-out portion so as to be carried by said cover plate and securely held in place; and fastener means for removably mounting said cover plate within the recessed portion of said coin chute flange;

inward movement of said coin slide placing an edge of a ferro-magnetic slug carried by said slide under said magnet causing the slug to be raised up against said magnet;

whereby continued inward movement of said coin slide causes the raised slug to abut against said abutment surface to prevent further movement of said coin slide to its operate position inwardly of said assembly.

* * * * *